US008177265B2

(12) United States Patent
Stevens

(10) Patent No.: US 8,177,265 B2
(45) Date of Patent: May 15, 2012

(54) LATCH

(75) Inventor: Kevin John Stevens, Lower Hutt (NZ)

(73) Assignee: Assa Abloy New Zealand Limited, Auckland (NZ)

( * ) Notice: Subject to any disclaimer, the term of this patent is extended or adjusted under 35 U.S.C. 154(b) by 1005 days.

(21) Appl. No.: 11/665,774

(22) PCT Filed: Oct. 25, 2005

(86) PCT No.: PCT/NZ2005/000280

§ 371 (c)(1),
(2), (4) Date: Dec. 21, 2007

(87) PCT Pub. No.: WO2006/043841

PCT Pub. Date: Apr. 27, 2006

(65) Prior Publication Data

US 2008/0211238 A1 Sep. 4, 2008

(30) Foreign Application Priority Data

Oct. 22, 2004 (NZ) ..... 536121

(51) Int. Cl.
*E05C 1/02* (2006.01)
*E05C 1/00* (2006.01)

(52) U.S. Cl. ..... 292/177; 292/179; 292/251.5; 292/DIG. 20

(58) Field of Classification Search ..... 292/177, 292/179, 181, 251.5, DIG. 20, 163
See application file for complete search history.

(56) References Cited

U.S. PATENT DOCUMENTS

| | | | | |
|---|---|---|---|---|
| 111,524 | A * | 2/1871 | Drott | 292/182 |
| 2,471,634 | A * | 5/1949 | Vennice et al. | 49/395 |
| 3,794,366 | A | 2/1974 | Graham | |
| 5,362,116 | A | 11/1994 | Doyle et al. | |
| 6,630,877 | B2 * | 10/2003 | Manthey | 335/205 |
| 7,118,142 | B2 * | 10/2006 | Xu | 292/139 |
| 7,165,792 | B2 * | 1/2007 | Queveau et al. | 292/251.5 |
| 2005/0146143 | A1 * | 7/2005 | Lutfallah | 292/153 |
| 2007/0194578 | A1 * | 8/2007 | Boosey et al. | 292/251.5 |
| 2008/0129054 | A1 * | 6/2008 | Tremble et al. | 292/33 |

FOREIGN PATENT DOCUMENTS

| | | |
|---|---|---|
| GB | 2 286 627 | 8/1995 |
| WO | WO 2005/078218 | 8/2005 |

* cited by examiner

*Primary Examiner* — Carlos Lugo
(74) *Attorney, Agent, or Firm* — DeLio & Peterson, LLC

(57) ABSTRACT

A latch assembly for use with a window sash sliding mounted with a window frame. The latch includes at least one bolt (18) moveable in a body (10) between a retracted position and a projecting position. In the projecting position the bolt 18 is engageable in cavity in a strike (12). A connecting mechanism in the form of cranks (20) couple the bolt 18 to an operating member (14), which is part of latch furniture (11). A magnetic actuating element (29) and a biasing element (33) are coupled to the bolt (18) whereby when the latch body (10) is disposed relative to a strike (12) in a position where the bolt (18) can engage with the strike (12) a magnetic attraction between a magnetic part (26) of the strike and the magnetic actuating element (29) occurs to draw the bolt (18) into latching engagement with the strike (12).

26 Claims, 16 Drawing Sheets

S
40a
43
40
44
42
41
S
H
40b
10

S
10
43
S
41
H

S
10
43
F'
S
F
42

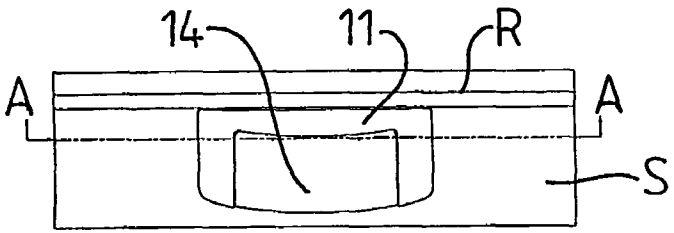
FIG. 23
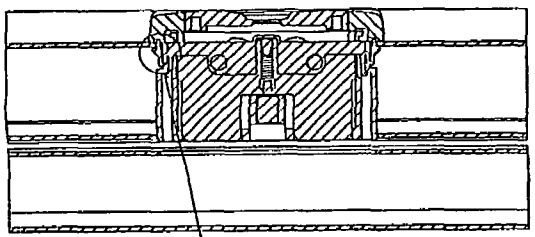
FIG. 24
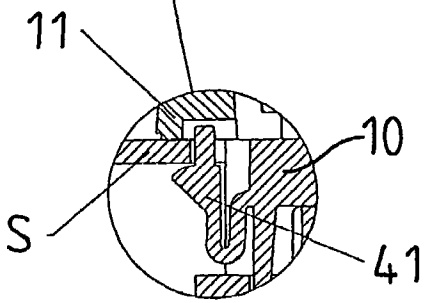
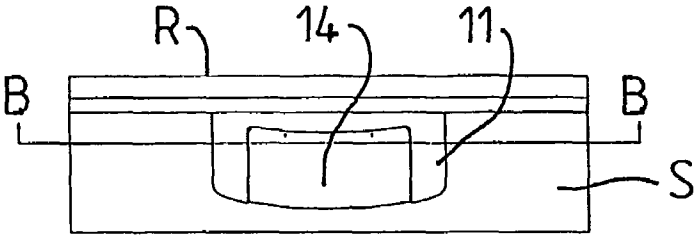
FIG. 25
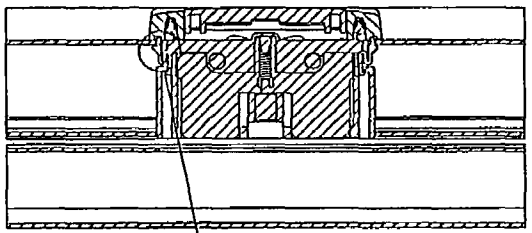
FIG. 26
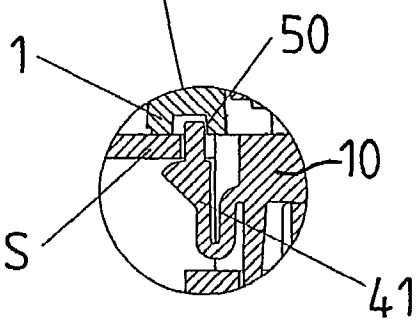

FIG. 30
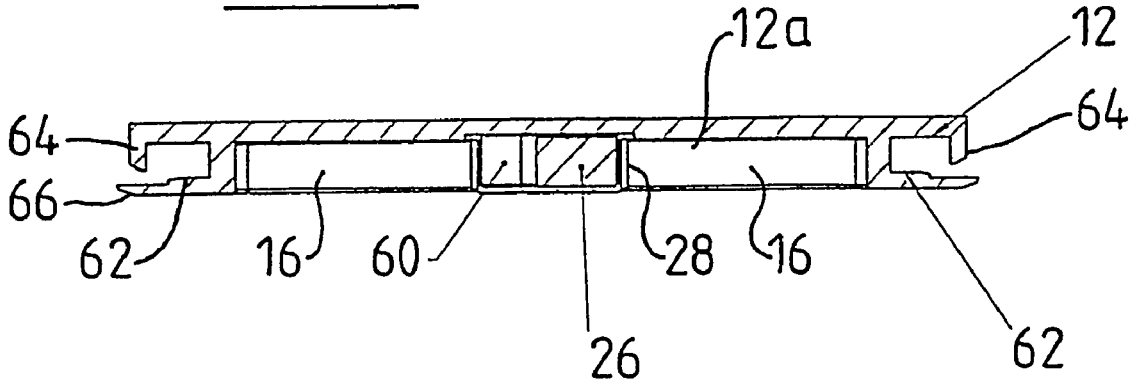
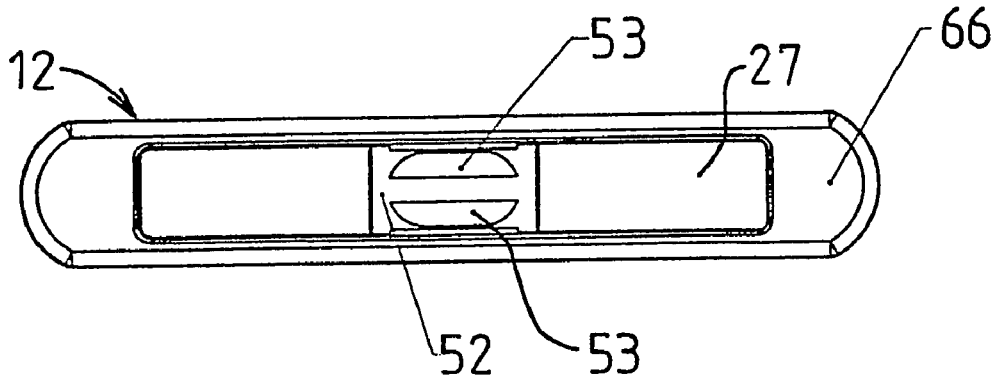
FIG. 31

LATCH

This is a non-provisional application claiming the benefit of International application number PCT/NZ2005/000280 filed Oct. 25, 2005.

BACKGROUND TO THE INVENTION

This invention relates to a latch. More particularly the latch is intended for use with a window sash which is sliding mounted with a window frame.

Latch devices for latching a sliding window sash in the closed position are known. However, there are drawbacks or shortcomings in many of the known latch devices. In these more security conscious times previously known latch devices may not provide the level of security required nowadays.

For example, a security issue arises if a latch device can be disengaged and remain so in the event that the window sash is not moved from the closed position. As a result the window sash may appear to be latched closed but in reality is unlatched. Therefore unauthorised entry through the window can occur.

Another situation which can occur with many known latching devices is that upon the window sash being moved into a closed position the latching device needs to be manually manipulated in order to achieve latching. There are, however, known latching devices which automatically relatch upon the sash moving to the closed position. These rely on some mechanical triggering between a moving element (rail) of the sash and fixed element (rail) of the window frame. Thus, if the mechanical triggering does not occur or fully trigger the relatching, the sash is closed but not latched. Thus the security issue mentioned above once again exists.

SUMMARY OF THE INVENTION

An object of the present invention is thus to provide a latch for use within a window sash sliding mounted with a window frame, the latch being of a construction such that when the sash is in the closed position latching occurs without any mechanical triggering between moving and fixed elements of the sash and frame.

Broadly according to one aspect of the invention there is provided a latch for use with a window sash sliding mounted with a window frame the latch including at least one bolt moveable between a retracted position and a projecting position whereby in the projecting position the bolt is engageable in a strike, a connecting mechanism, coupled to the bolt, and operable by an operating member, a magnetic actuating element, and biasing means coupled between the magnetic actuating element and the bolt whereby when the latch is disposed relative to a strike in a position where the bolt can engage with the strike a magnetic attraction between the strike and the magnetic actuating element occurs.

Some windows have two moving sashes (double hung) as opposed to one moving and the other fixed (single hung).

In the case of two moving sashes a latch that requires any mechanical force to operate may cause the sash with the strike on to move away and therefore not latch. This latch, operating by magnetic attraction does not apply any forces to the sash with the strike on. Therefore the second sash does not see any forces that could cause it to move.

The bolt in this design has more travel than required to engage into the strike with the window sash in a nominal position. Any external forces applied to the window (forced entry) that may cause the window sections to be moved or distorted away from each other will not cause the bolt to become disengaged from the strike. As the magnetic attraction force pulling the bolt towards the strike will maintain the bolt engagement into the strike and take up some of the free travel built into the design.

BRIEF DESCRIPTION OF THE DRAWINGS

In the following reference will be made to the accompanying drawings in which:—

FIG. 23 is a plan view of the arrangement shown in FIG. 19, FIG. 24 is a cross-sectional side elevation view taken on line A-A of FIG. 23, FIG. 25 is a plan view of the arrangement shown in FIG. 21, FIG. 26 is a cross-section taken on line B-B of FIG. 25, FIG. 30 is a cross-sectional elevation of the striker, FIG. 31 is a top plan view of the striker but with the magnet and magnet housing removed.

DETAILED DESCRIPTION OF PREFERRED EMBODIMENTS OF THE INVENTION

The latch according to the present invention is intended for use with a sliding window sash. The latch is intended to fit into an element such as a rail section S of the moveable window sash and more particularly, but not limited to, a PVC window sash. Fitting to wooden or aluminium sashes would also be possible. As the latch mechanism is fitted into the moving rail section S it is therefore hidden from sight (see FIGS. 18 and 18*a*). The latch furniture 11 is flush mounted to the height of the pull rail R, on the front face of the sash section S. It is therefore unobtrusive and does not project into the window viewing space, as do top mounted sash latching devices.

Figure 18:
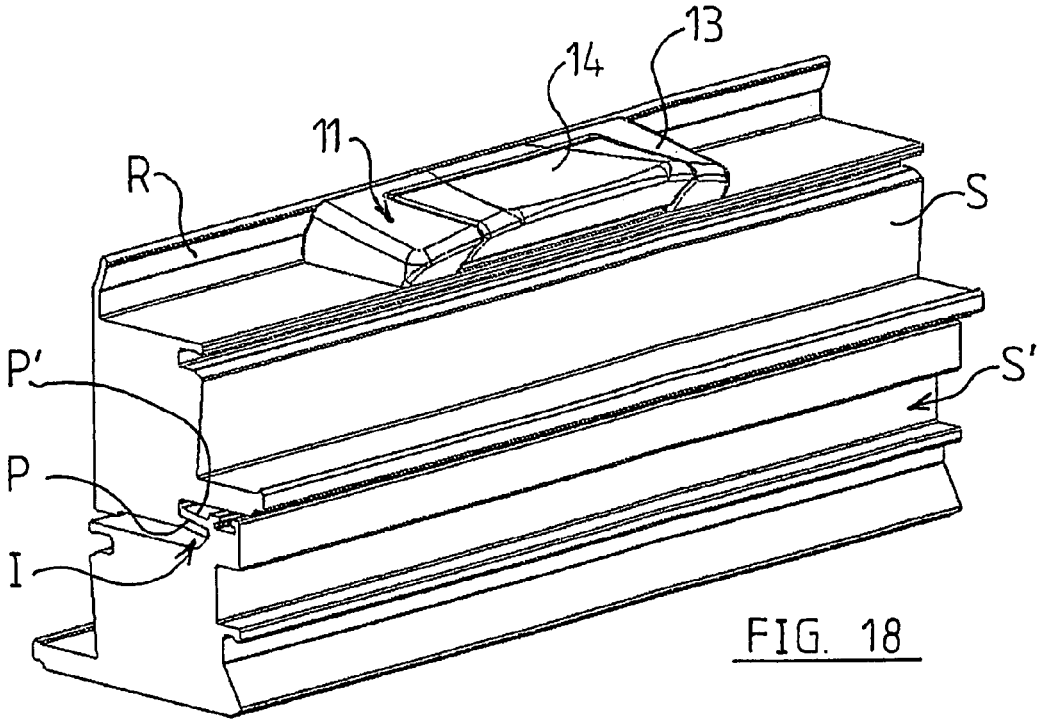
FIG. 18 is a perspective view of the complete latch assembly mounted in a window section.
Figure 18A:
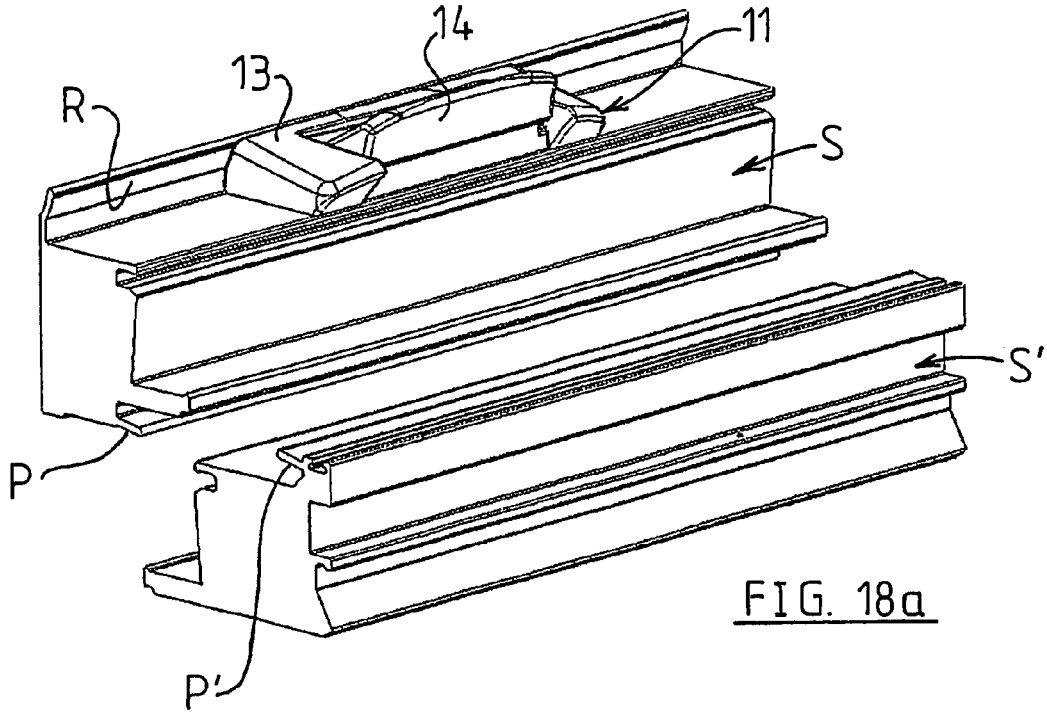
FIG. 18*a* is a view similar to FIG. 18 but with the window section in an open position.
Figure 20:
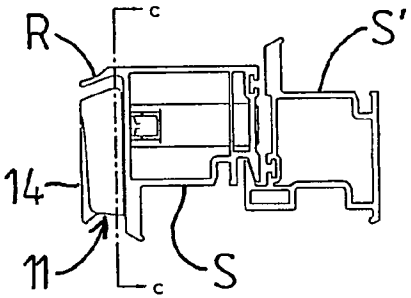
FIG. 20 is a section on line C-C of FIG. 19.
Figure 21:
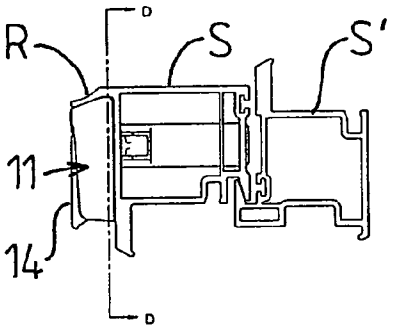
FIG. 21 is a view similar to FIG. 19 but showing the latch furniture moved into the locking position.

Mortised attitude provides the opportunity that in the appropriate section design there is no need to rout through the interlocker I (i.e. the engaging portions P and P' of the window sections S and S' (see FIGS. 18 and 18*a*).

The latch according to the present invention can be used in different window types namely (a) single sash horizontal sliding (b) single hung with one vertical sliding sash or (c) double hung with two vertical sliding sashes.

The latch in its entire assembly comprises a latch body or housing 10, operating latch furniture 11 and a strike 12.

The latch furniture 11 consists of an external housing or escutcheon 13 to which is pivotally coupled (as will hereinafter be described) to a handle 14. The latch body 10 has two clips 45, which engage in suitably shaped recesses 48, 49 in the escutcheon 13, as will hereinafter be described to couple the furniture 11 to the body 10.

The latch furniture 11 can thus fit onto the body 10 in such a manner that the furniture 11 will also be able to be moved sideways with respect to the latch body 10. This will allow the latch body 10 to be fitted into a slot H machined in the moving rail S of the window (from the inside face of the moving sash of the window) and the furniture 11 then moved transverse to the body 10 to lock the latch 10 in position in the section S.

The transverse movement of the furniture 11 will cause clips on the lock body to engage with the back of the furniture escutcheon 13 and thereby lock the latch body 10 in place in section S.

It is also envisaged that the sideways movement of the furniture 11 will result in the furniture being pushed under a pull rail upstand R (if it exists—an example being shown in FIGS. 18 and 18*a*) on the moving rail section S of the window sash. This has the advantage that the furniture 11 can be made to take on the appearance of being joined to the push rail upstand R and thereby lead to an aesthetically pleasing result.

Figure 1:
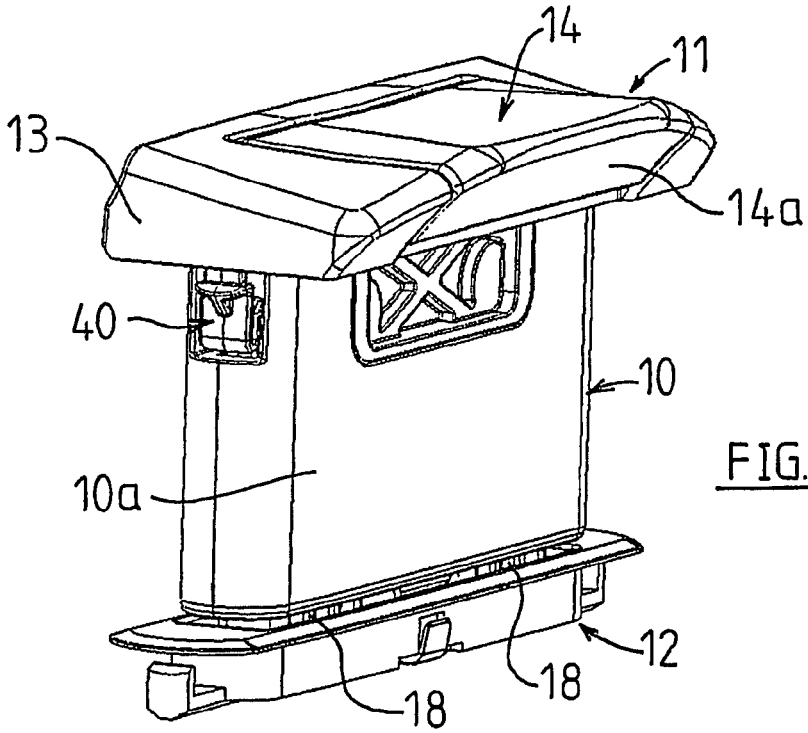
FIG. 1 is a perspective view of the latch and combination with latch furniture and a latch strike.
Figure 2:
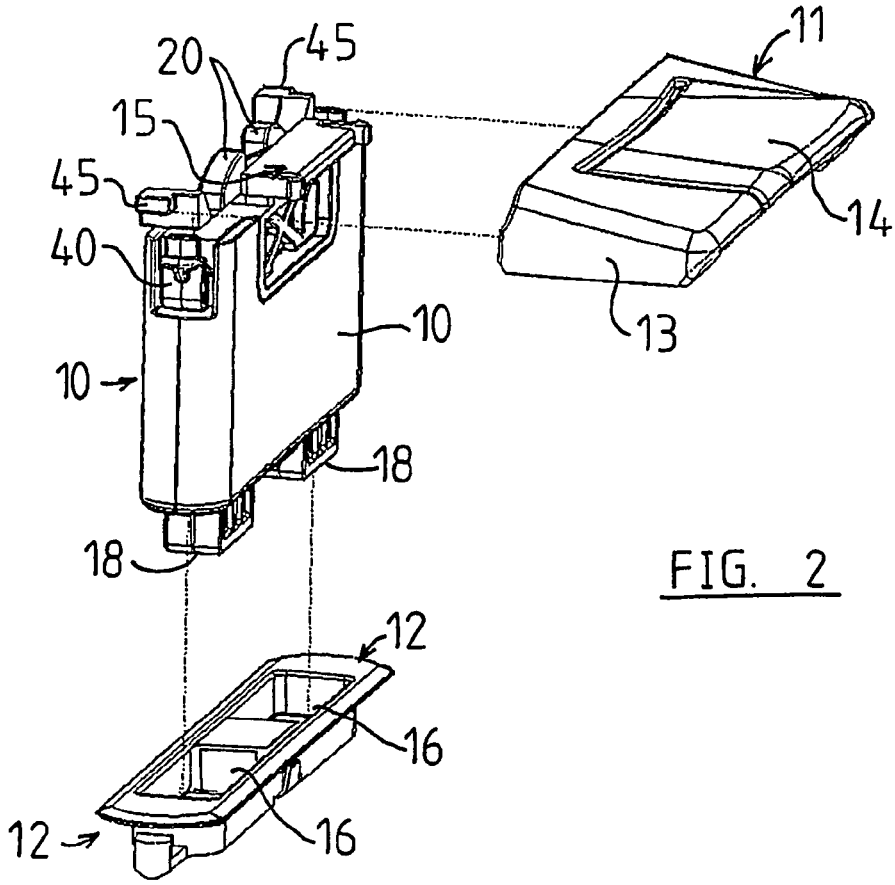
FIG. 2 is an exploded perspective view of the arrangement shown in FIG. 1.
Figure 3:
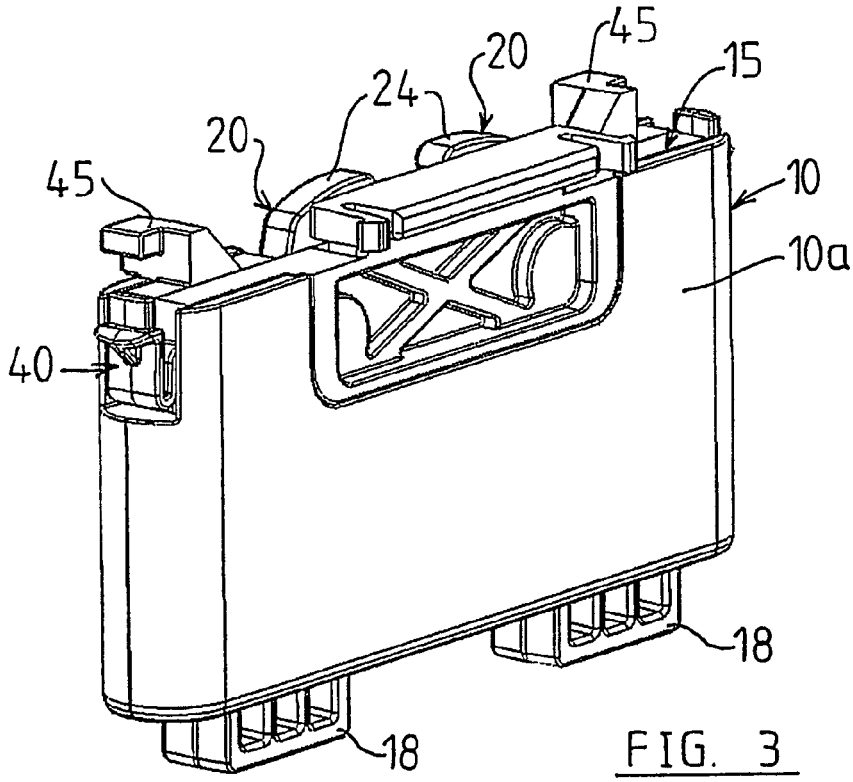
FIG. 3 is a perspective view of the latch shown in FIGS. 1 and 2.
Figure 4:
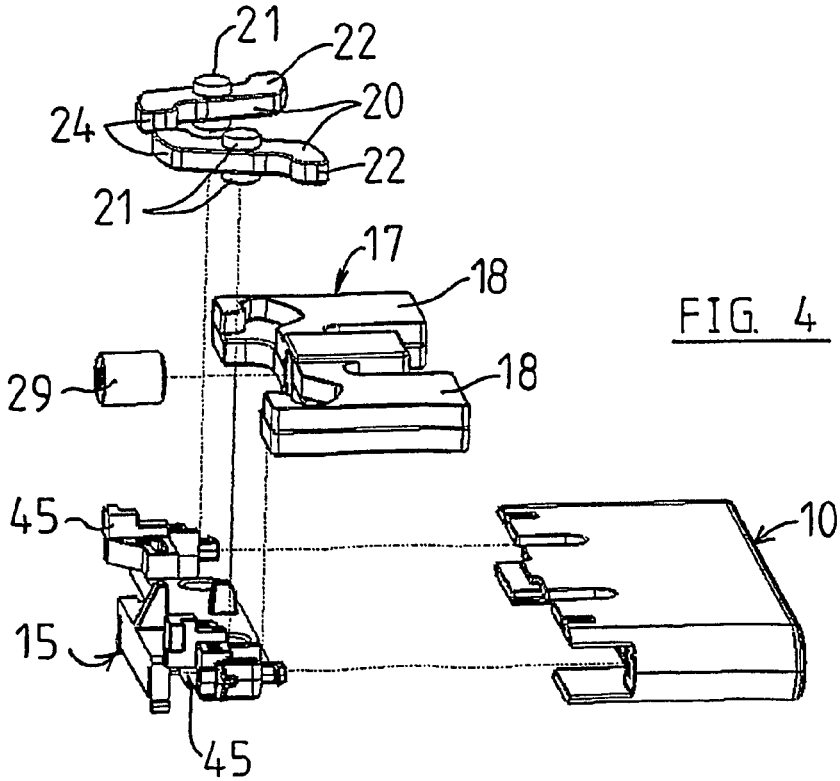
FIG. 4 is an exploded perspective view of the latch of FIG. 3.

In the drawings, a cover piece or plate (identified at 10*a* in FIGS. 1-3) of the body 10 is absent so as to reveal the internal elements of the latch. It is envisaged, however, that the body 10 can be a one piece moulding into which the operating elements of the latch mechanism can be fitted.

Within the body 10 there is a bolt assembly 17 which preferably, as shown, comprises a pair of bolts 18.

Figure 5:
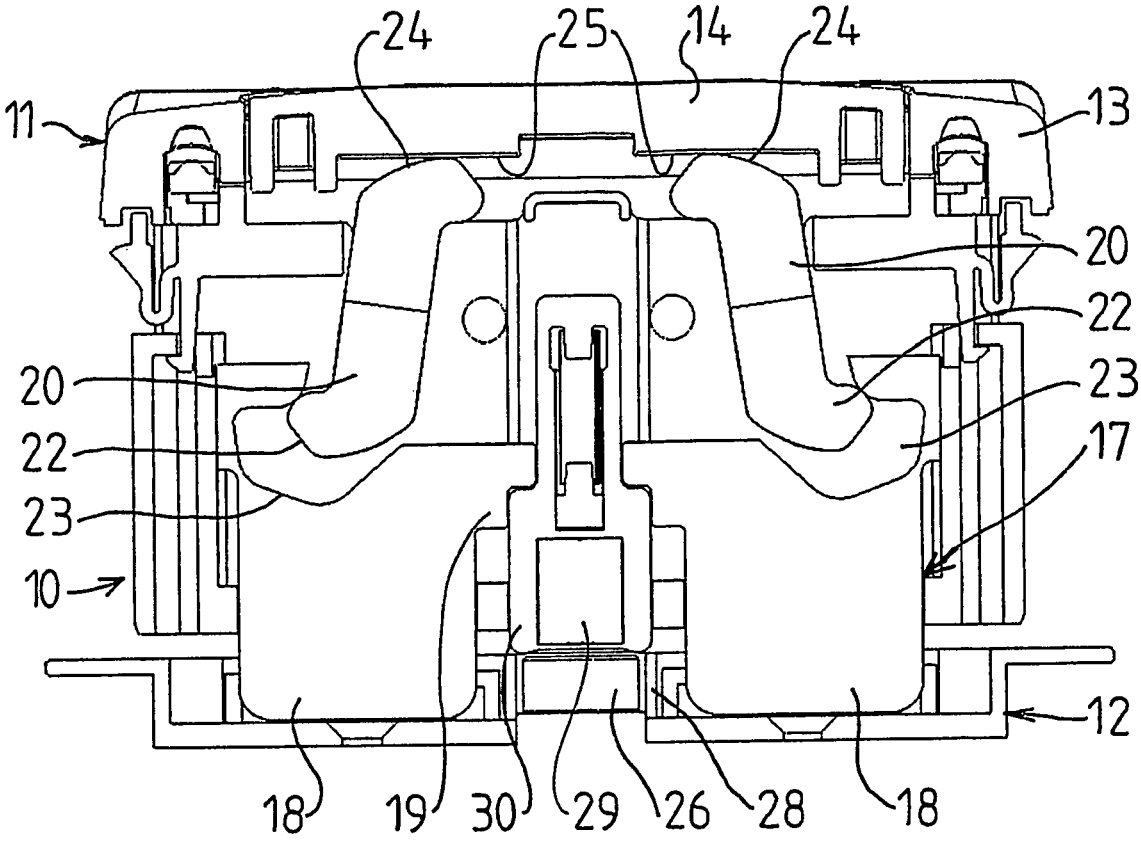
FIG. 5 is a cut away elevation view of the latch, furniture and strike according to one embodiment, the latch being in a latched position.

Distal ends of these bolts 18 are extendable to project from the body 10 to engage in recesses 16 in the strike 12. FIG. 5 shows the bolt assembly 17 in the extended latching position whereby the distal ends of the bolts 18 are engaged in the recesses 16 in the strike 12.

The bolts 18 are joined together by yoke 19 and thus move as a unit. Pivotally mounted between opposed walls of the body 10 is a pair of bell cranks 20. These pivot about the axis of pivot pins 21. Shaped ends 22 of the bell cranks 20 engage in recesses 23 of respective of the bolts 18.

Curved surfaces 24 engage with a surface 25 of handle 14. Thus when the user accessible portion 14*a* of the handle 14 is lifted into the position shown in e.g. FIG. 18*a* the pressure surface 25 moves down to push on the curved surfaces 24 of bell cranks 20 thereby causing the bell cranks 20 to pivot about the axis of pivot pins 21. As a result the shaped ends 22 engaging in recess 23 of each of the bolts 18 causes the bolt assembly 17 to be moved into the unlatched condition as shown in FIGS. 6 and 7.

Figure 10:
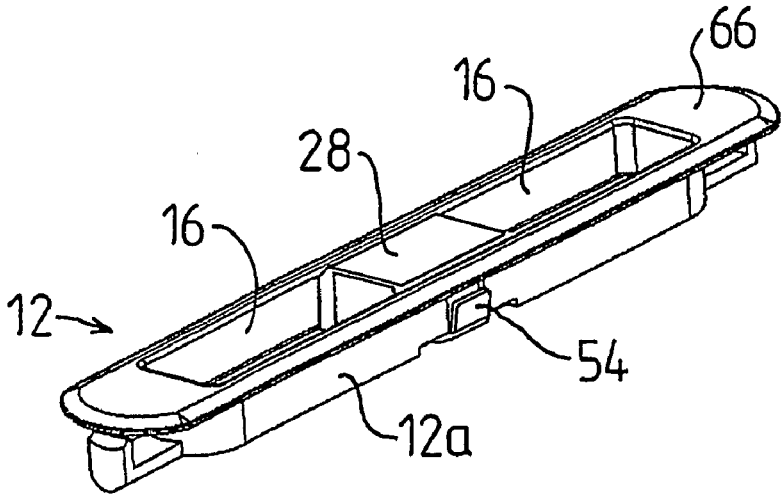
FIG. 10 is a perspective view of the strike.
Figure 11:
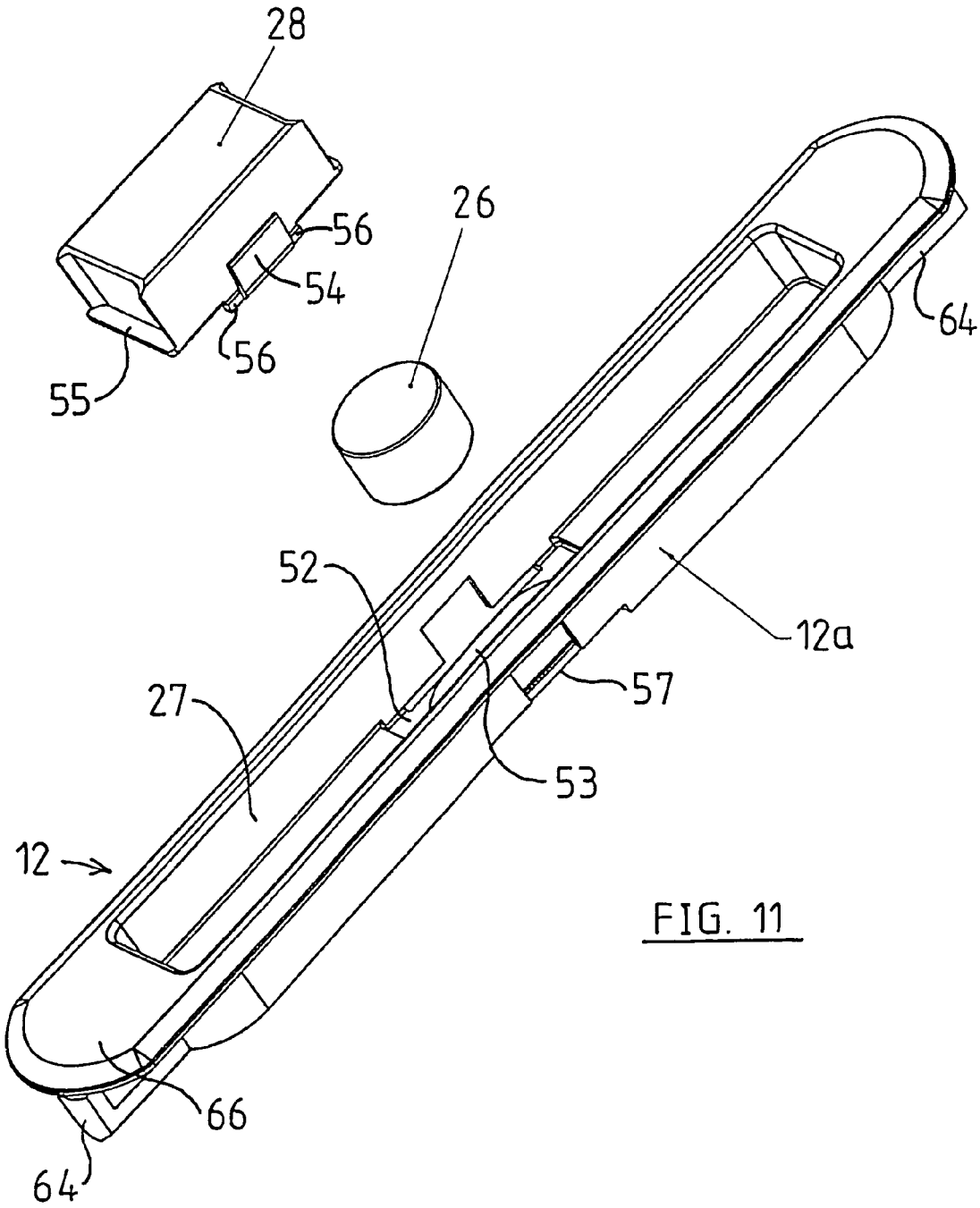
FIG. 11 is an exploded perspective view of the strike.

A magnet 26 is located in a shaped cavity in a housing 28 in the strike 12. The housing is clip fitted into cavity 27 to retain the magnet 26 in the cavity in housing 28. This construction is more particularly shown in FIGS. 10 and 11. The strike magnet 26 is preferably sealed in the cavity in housing 28 to help eliminate moisture and the possibility of corrosion. The housing 28 when clip fitted into cavity 27 divides the cavity 27 into two sections to form the recesses 16 into which the bolts 18 engage.

A second magnet 29 is fitted in a movable magnet carrier 30 housed within the latch body 10. The magnets 26 and 29 are arranged so that they will attract each other when the latch assembly approaches the strike 12. FIG. 5 shows the magnets 26 and 29 attracted together.

Figure 6:
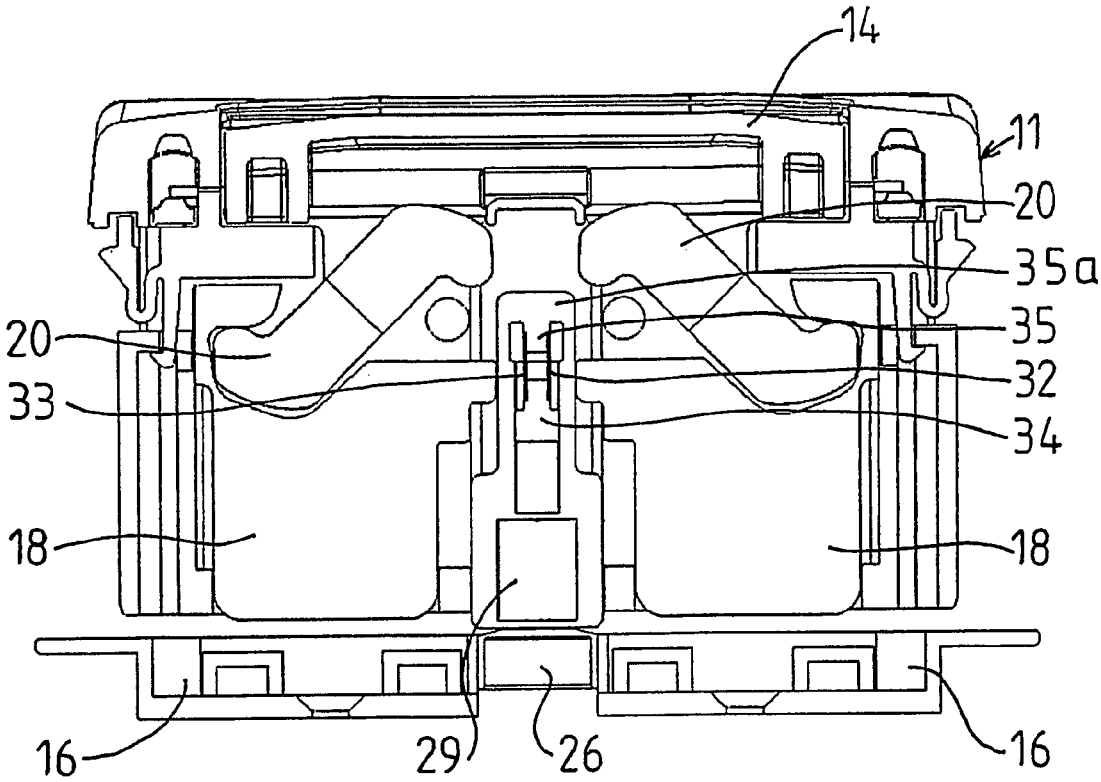
FIG. 6 is a view similar to FIG. 5 but showing the latch in an unlatched condition, and a magnet carrier of the magnetic actuating element in an extended position.
Figure 7:
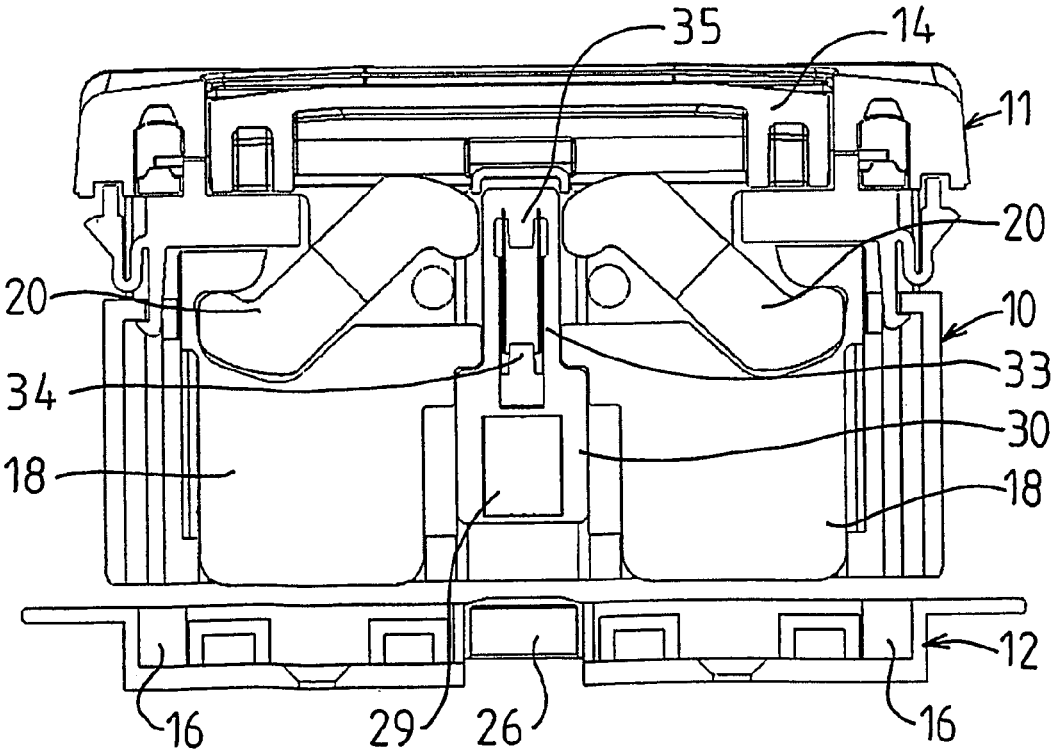
FIG. 7 is a view similar to FIG. 6 with the latch in an unlatched condition and a magnet carrier of the magnetic actuating element in the retracted position.

FIG. 6 shows the bolt assembly 17 moved into an unlatched condition. However, the magnet carrier 30, which is movable independent of but coupled to the bolt assembly 17, remains in the "attracted" position on the strike 12.

As can be seen more clearly in FIG. 6, the magnet carrier 30 includes a projecting portion 31 in which there is a cavity 32. A compression spring 33 (see FIG. 7) locates within the cavity 32.

The yoke 19 of the bolt assembly 17 has a lug or projection 34 which engages in the cavity 32. Between this lug 34 and a similar lug 35 on end wall 35*a* of the cavity 32 is located the compression spring 33.

Because of the magnetic attraction force of the two magnets 26 and 29 the magnet carrier 30 stays touching the strike 12 but due to the movement of the bolt assembly 17 the spring 33 is compressed. This condition is shown in FIG. 6. Thus, if the sash section S in which the latch body 10 is located is not moved relative to the strike 12, and the force which moved the handle 14 is released, the force of the spring 33 will relatch the sash by moving the bolt assembly 17 forward into the latched position so that the distal ends of the bolts 18 locate in the strike 12.

If, however, the sash is moved, the latch magnet 29 then moves sideways over the strike magnet 26 until the two magnets are no longer attracted to each other. At this point spring 33 pulls the magnet carrier 30 back inside the latch body 10 (i.e. the configuration as shown in FIG. 7).

In this form of the invention two bolt return springs (not shown) hold the bolt assembly 17 back inside the latch body 10. The action of the spring 33 of the magnet carrier 30 also assists in holding the bolt assembly 17 back within the body 10.

Figure 12:
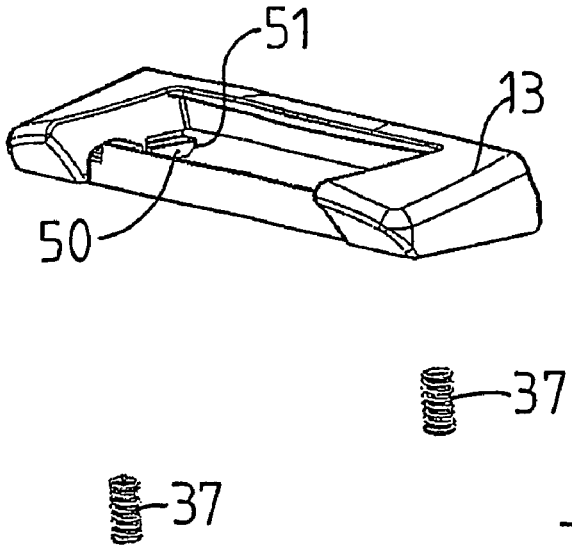
FIG. 12 is an exploded view of the furniture.

Referring to FIG. 12 the handle 14 includes a lug or spigot 36 which engages one end of a spring 37. The other end of the spring 37 engages on a land or in a recess in the escutcheon 13. As a result the springs 37 holds the handle 14 in the up position thereby giving a visual indication that the latch is unlatched.

If the sash is moved in the closing direction so that the latch approaches the strike 12 attraction between the magnets 26 and 29 will be re-established. Thus the magnet carrier 30 will be attracted forward and as a consequence of this movement the bolt assembly 17 is moved forward so that the distal ends of the bolts 18 move forward onto the strike 12. It will be appreciated by those skilled in the art that as the two magnets 26 and 29 get closer together the force of attraction becomes greater. It is this force that pulls the bolt assembly 17 toward the strike 12.

Ultimately the magnetic attraction will pull the magnet carrier 30 down onto the strike 12 which will result in compression of the magnet carrier spring 33. As the sash moves into its fully closed position the bolts 18 become aligned with the recesses 16 in the strike 12. At this point the magnet carrier spring 33 moves the bolt assembly 17 forward into the fully latched position as shown in FIG. 5.

As the bolt assembly 17 moves forward the two bell cranks 20 push the handle 14 into the position where the handle 14 is now flush with the surface of the escutcheon 13. This provides a visual indication that the sash is latched.

In a nominal cavity position the bolts 18 have an amount of penetration into the strike 12. The latch, however, is of such a construction that there is more travel than is required for a nominal cavity condition. Thus even if the body 10 is spaced further from the strike 12 than shown in FIG. 5 the bolts 18 will be extended sufficiently to engage in and remain in the strike 12 until unlatched therefrom.

Thus, this construction not only provides for varying distance between the body 10 and strike 12 but also ensures that the bolts 18 remain in contact with the strike if the sash S and frame S' are forced apart in, for example, an attempt by an intruder to withdraw the bolts 18 from the strike 12. The force of attraction of the magnets 26 and 29 maintain the contact between the magnet carrier 30 and the face of the strike 12 so that as the two sections S and S' move apart the bolts 18 will move further out of the latch body 10 and maintain the required penetration inside the strike 12.

As the bolt assembly 17 is pulled further out of the latch body 10 the bell cranks 20 also move and the handle 14 moves to a position that is below the furniture surface. The shape of the ends 22 of the bell cranks 20 and the face of the cavities 23 on which the bell cranks engage is, in the preferred form of the invention, designed to give less relative movement of the handle so that only a small gap is required between the handle and the window sash rail in the nominal condition to allow for this additional travel.

The foregoing describes one embodiment of the invention. It will be appreciated by those skilled in the art that the latch is open to modification. For example, in the illustrated form of the invention the latch body 10 is of two pieces and includes a cover which was previously described as not shown in the drawings. However, according to an alternative form of the invention the body can, as disclosed above, be of one-piece construction.

Figure 8:
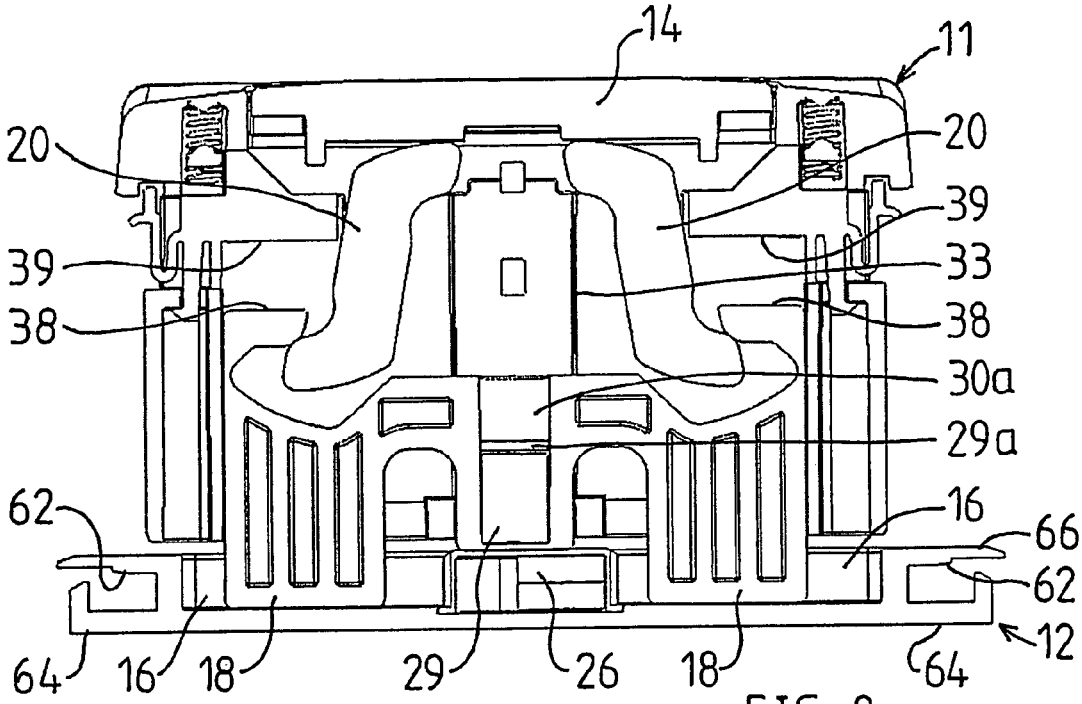
FIG. 8 is a view similar to FIG. 5 but showing a second embodiment of the latch.
Figure 9:
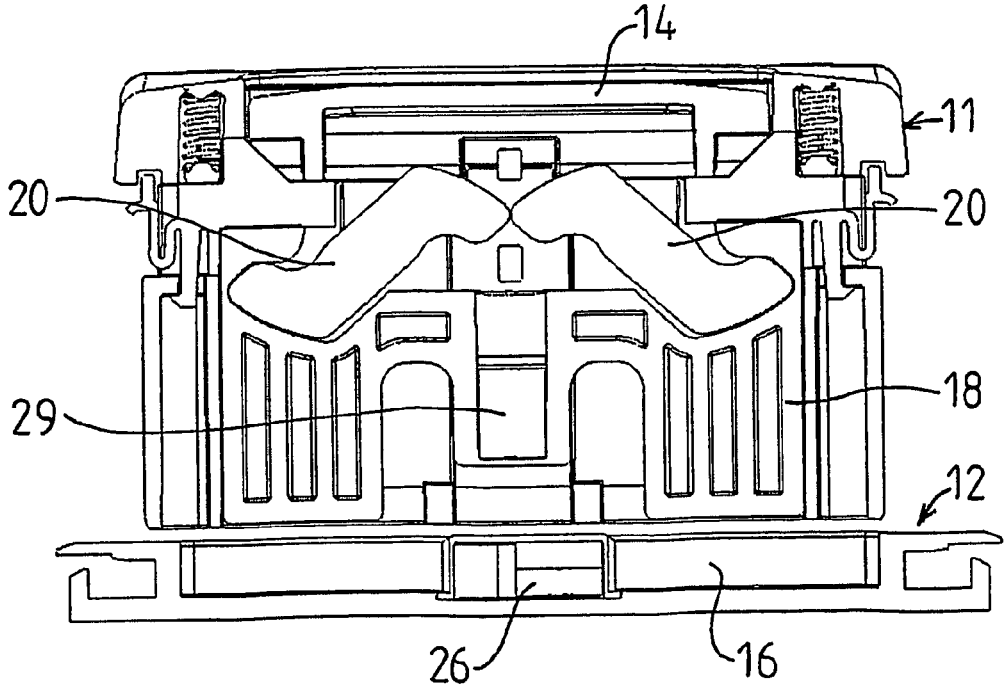
FIG. 9 is a view similar to FIG. 8 but showing the bolts fully retracted from the strike.

According to a further form of the invention as shown in FIGS. 8 and 9 there is no movable magnet carrier 30 but rather a cavity 30*a* incorporated with yoke 19 and in which the magnet 29 is retained by plug 29*a* (see FIG. 8). The magnet 29 is thus fixed to the bolt assembly 17. Consequently the magnets 29 and 26 must be pulled apart (rather than sheared) before the bolts 18 separate from the strike 12. This requires a greater leverage in the handle 14. FIG. 9 shows the handle 14 having been moved to lift, via the action of the cranks 20, the bolt assembly 17 away from the strike and into an unlatched position.

The handle 14 can be arranged so that when the handle is nearly in its fully up position the compressive force in the magnetic carrier spring 33 exceeds the magnetic attraction force between the latch magnet 29 and the strike magnet 26. At this point the magnet carrier spring 33 pulls the magnet carrier 30*a* toward the bolt assembly 17 until the surface 38 of the yolk 19 hits/contacts surface 39 of the body 10 (see FIG. 9). As a result of this movement and the contact of these two surfaces 38 and 39 an audible click is heard.

Thus contrary to the first embodiment, as described herein, the magnet carrier 30 does not stay in contact with the strike 12 until the sash is moved. In this modified form of the invention the magnet carrier 30*a* moves away from the strike 12 prior to the sash being moved. This means that while a greater force may be required to move the handle to separate the magnets there is no resistance to sliding of the window sash open other than the normal seal forces.

According to a further modification of the first embodiment, the position and strength of the furniture handle springs 37 is such that the two bolt return springs in the first embodiment may no longer be required. In this modified form of the invention the furniture handle springs 37 are used to not only hold the handle 14 in the up position, when the latch is unlatched, but also to apply pressure to the bell cranks 20 to thereby hold the bolt assembly 17 in the retracted position when the latch is open and the sash moved.

The latch according to the present invention thus provides for automatic movement of the bolts 18 to move into the locking position once the sash is in the closed position without any mechanical triggering being required between the fixed and moving rails of the window. Furthermore, the latch will self re-engage with the strike in the event that the sash is not moved and the handle is released.

A further advantage of the latch is that once the bolt assembly 17 has retracted into the body 10 it stays retracted so that there is no part of the latch mechanism which can come into contact with any other part of the window during movement of the sash.

In the preferred form of the invention the operation of the furniture 11 is in the same direction as the opening of the sash. Therefore, the movement of the sash in its sliding direction naturally follows the movement of the handle 14 to carry out unlatching of the latch. As well as being a highly intuitive operation mode, this aspect provides the opportunity to meet the needs of those with limited disabilities. Once the handle has been moved to unlatch the latch there is a visual indication that this latch is unlocked.

According to another aspect of the invention, installation of the latch and strike is straight forward and can be carried out without any additional fixing screws nor tools to achieve installation. The strike is preferably a simple clip fit (as described hereafter) but could have the facility for fixing screws to be fitted if such is required for higher security installations. The latch body is fitted from one side of the window section and requires no additional fixing screws nor tools to install.

It is known in the art to clip fit a part of a latch e.g. the latch body or chassis into a rout formed in the section of the window in which the latch is to be fitted. The clipping arrangement generally includes a clip of inherent resilience so that it can deflect when the latch body is installed into the rout in the section but then resumes its normal position after the clip has passed through the rout to thereby engage with the window section so as to prevent the latch body from being readily removed from the section.

Typically fabricated routs are notorious for having deformed edges or burrs, which can cause the clips to fail to snap back into position to retain the latch body fully. Also, spring clips are only as strong as the pre-determined spring pressure and, therefore, can be overridden if enough force is applied. While strong spring clips can provide sufficient holding force the latch is then difficult to remove for servicing.

Figures 13, 14, 15:
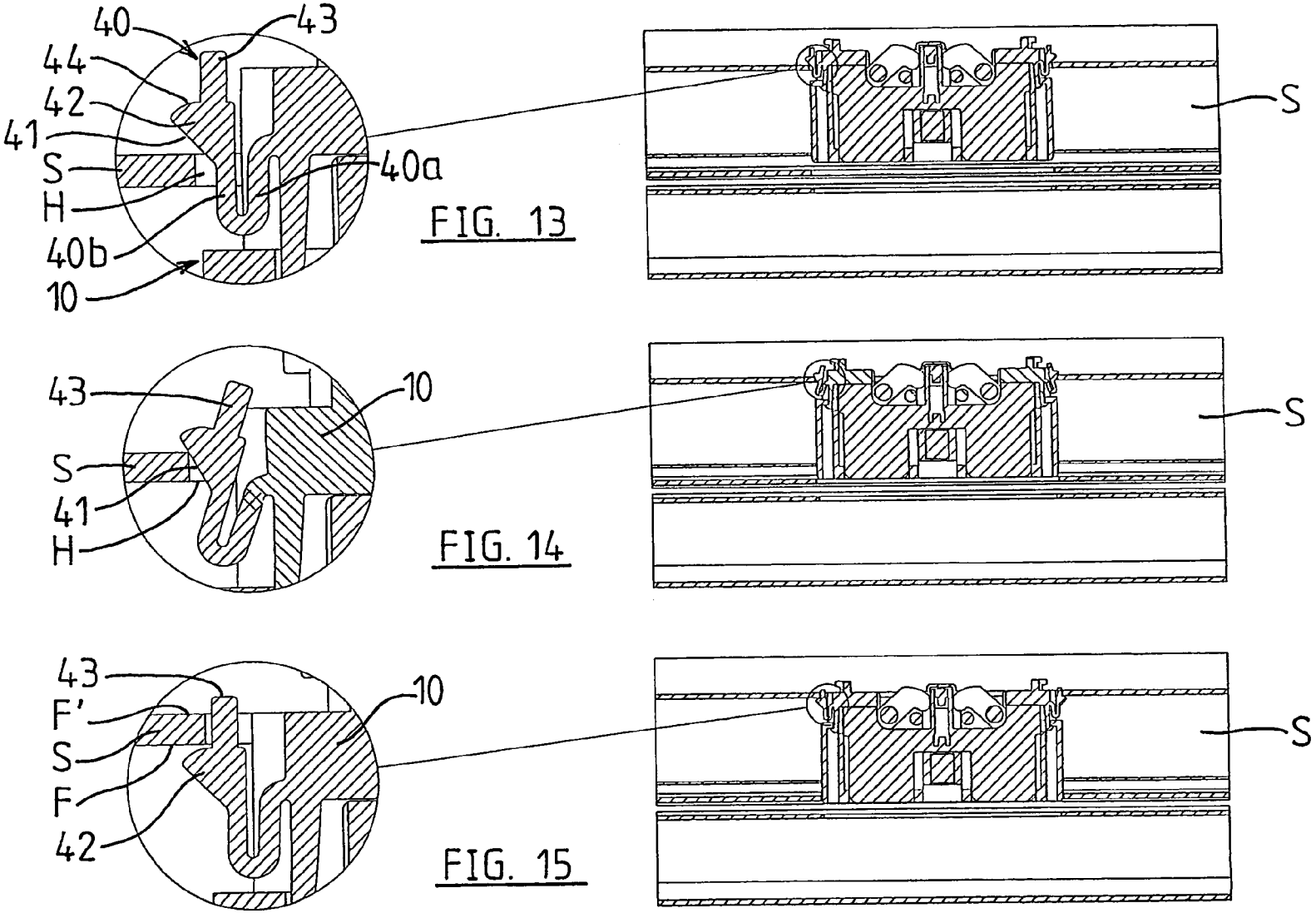
FIG. 13 is a cross-section elevation of the latch, without latch furniture, in position in a rout in a window section prior to clip installation therein.
FIG. 14 is a view similar to FIG. 13 but showing the latch part way through the clip installation thereof in the window section.
FIG. 15 is a view similar to FIGS. 13 and 14 but showing the latch clipped into the window section.

As will be apparent from the following and the drawings comprising particularly FIGS. 13-15, the latch body 10 preferably incorporates two clips 40, one either side of the latch mechanism and formed as part of the clip in section 15 of latch body 10. These clips 40 engage the profile of the window section S when the latch body 10 is inserted into the slotted rout hole H.

As can be seen in the drawings clip 40 is formed integrally with the clip in section 15 which combines with latch body 10. Referring to FIG. 13 the clip 40 is of generally U-shape with the top of one leg 40*a* being fixed to the latch body section 15. The top of the other leg 40*b* of the U-shape is of enlarged cross-sectional thickness and forms a ramp 41. Extending upwardly from the enlarged area 42 is a finger 43. A curved surface 44 extends from the end of the ramp 42 toward to the finger 43.

As shown in FIGS. 13-15, the clip 40 deforms (FIG. 14) as the latch body 10 (with clip in section 15 already installed) is inserted into the rout hole H. This is caused by an interaction (FIG. 14) between the ramp 42 and edge of the hole H. When the latch body 10 is fully installed (FIG. 15) the natural resilience of the clip 40 causes the clip to resume its normal configuration whereupon the curved surface 44 is located beneath the inner surface F of the section S. As can be seen in FIG. 15, the finger 43 protrudes through the hole H to extend beyond the outer surface F' of the section S.

It will be appreciated that FIGS. 13-15 show the latch body without the latch furniture 11 installed thereon. In practice, however, the latch according to the present invention has the latch furniture 11 installed (as supplied) on the latch body 10.

The latch furniture 11 is locatable in two positions on the latch body 10, one being the supplied or first position ready for installation and is the position shown in FIGS. 16, 19, 20, 23 and 24. The latch furniture is, however, able to be slid into an installed or second position which is the position shown in FIGS. 17, 21, 22, 25 and 26.

The latch is particularly suitable for a sash profile design that has an undercut pull rail R. Consequently, with the latch body 10 and latch furniture 11 in the supplied position ready for installation, the latch can be inserted into the routed hole H and clip engaged therein. The latch furniture 11 is then pushed transverse to the latch body 10 into engagement with the pull rail R (i.e. the installed position) which locks the latch body 10 in place. With the latch furniture safely tucked under the pull rail R the latch cannot come out. However, by pulling the latch furniture 11 back to the initial or first position, the latch is able to be easily removed without the use of tools. This is evident from the following description.

Figure 19:
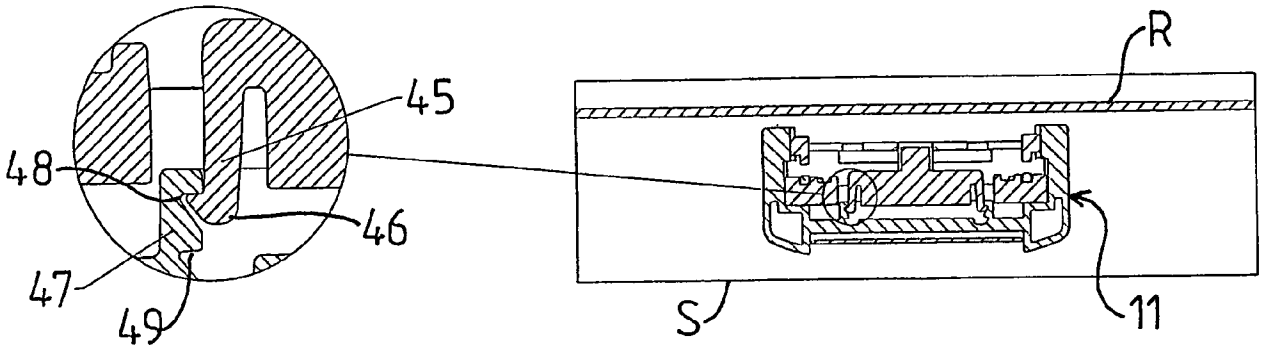
FIG. 19 is an elevation view of the latch and latch furniture when in the configuration shown in FIG. 16 but with the latch and latch furniture installed with a window section.
Figure 22:
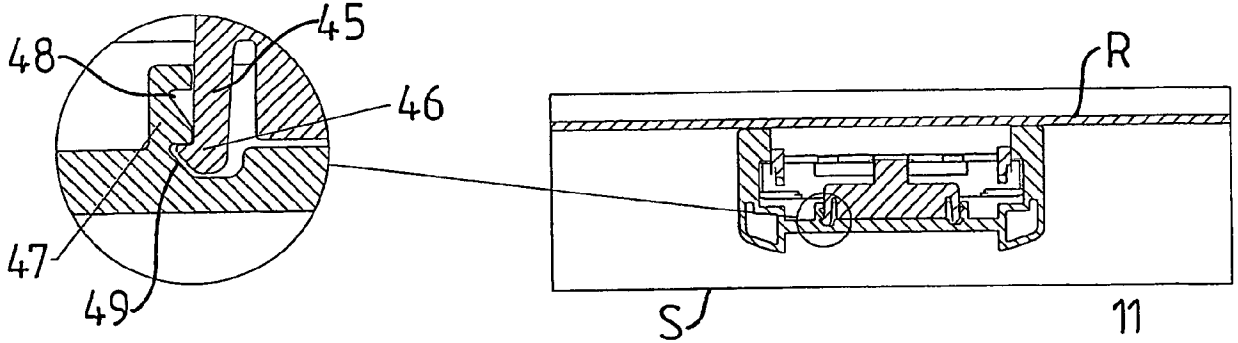
FIG. 22 is a section taken on line D-D of FIG. 21.
Figure 28:
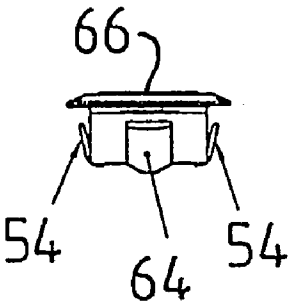
FIG. 28 is an end elevation view of the striker.
Figure 27:
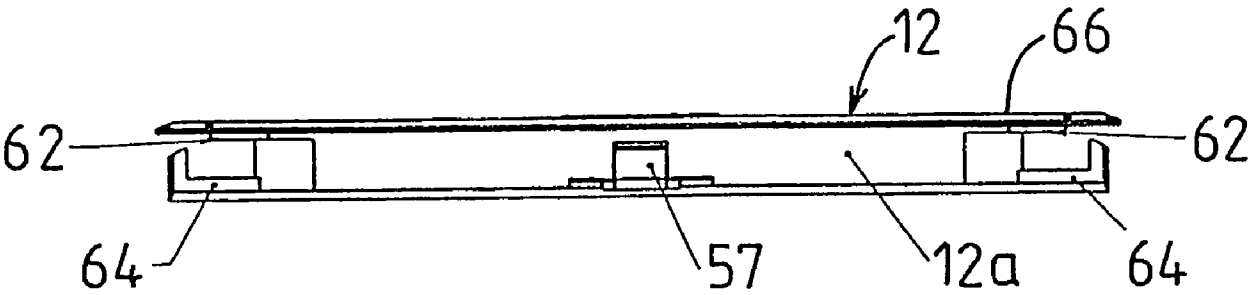
FIG. 27 is a side elevation view of the striker shown in FIG. 10.
Figure 29:
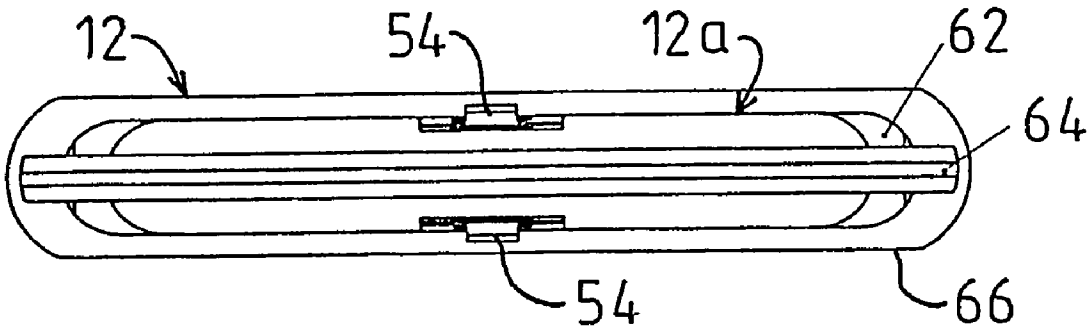
FIG. 29 is a bottom plan view of the striker.

There is an internal clipping arrangement in the latch body 10 that allows the latch furniture 11 to move and detent between the first and second positions. This is shown in FIGS. 19 and 22 where there is shown a clip 45 which is formed as part of the latch body 10. The hooked end 46 of this clip 45 engages with a clip receiving member 47 formed as part of the latch furniture 11. As shown in FIG. 19, the clip 45 engages with a first receiving recess 48 when the latch furniture is in the first position and a second clip receiving recess 49 when the latch furniture 11 has been slid to the second position. The arrangement is such that effectively detent positions are created which enables the latch furniture 11 to be moved between the two positions.

Figure 16:
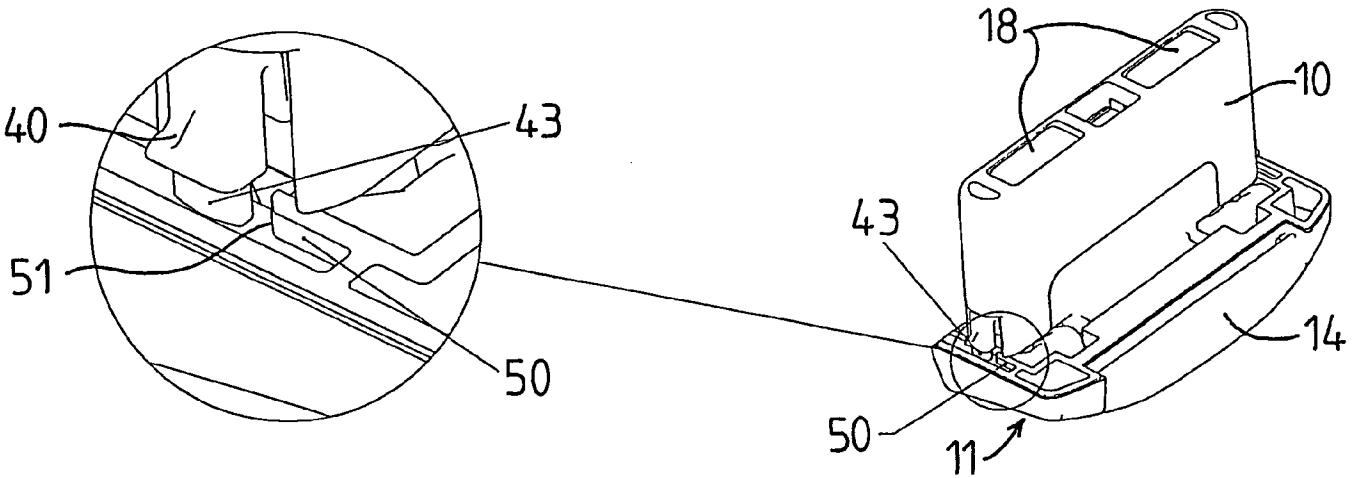
FIG. 16 is a perspective illustration of the latch furniture and latch when combined together.
Figure 17:
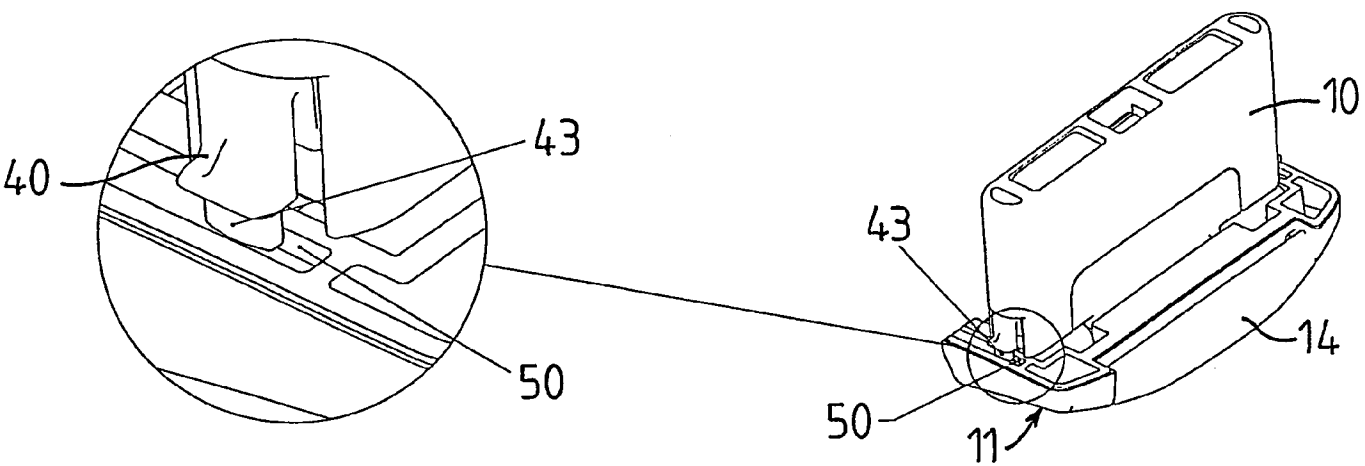
FIG. 17 is a view similar to FIG. 16 but showing the latch furniture moved into a locking position.

Referring now to FIGS. 16-17, and in particular FIG. 16, there is shown a clip locking feature 50 formed as part of the latch furniture 11. FIG. 16 shows the relationship of the clip locking feature 50 and the finger 43 of clip 40 when the latch furniture 11 is in the first position. FIG. 17 shows, however, that when the latch furniture 11 has moved to the second position the latch locking feature 50 moves behind the finger 43 thereby preventing the spring clip 40 from flexing and potentially releasing the latch body 10 from the rout hole H. The latch body 10 is, therefore, permanently locked into position until such time as the latch furniture 11 is slid back to the first position.

The locking feature 50 also includes a ramp 51 (see FIG. 16) at its distal end. Ramp 51 engages with the finger 43 as the latch furniture 11 is moved to the second position. It, therefore, drives the clip 40 into the retention position if a fabrication burr or deformed wall otherwise tends to hold the clip 40 back from clipping into the position shown in FIG. 15. Consequently, if the latch furniture 11 is moved successfully into the second position the installer can be certain that the clips 40 have fully engaged the profile of the window section S.

As the finger 43 is clear of the locking feature 50 during installation of the latch body 10 into rout H the section S, the clip 40 is able to flex and fulfil its normal operation as shown in FIGS. 13-15. It is only when the latch furniture 11 is slid into the second position that the clip locking feature 50 retains the clip 40 against flexing.

According to the described construction, the movement of the latch furniture 11 from the first to second positions creates a positive pressure oh the clips 40 thereby ensuring that the clips 40 correctly clip the body 10 into the section S. In addition, however, the clips 40 are retained in the clipping position to ensure that the latch body 10 is retained in the section.

Because the latch, according to the present invention, is reliant upon magnetic attraction between a magnet and the latch mechanism fitted in the moving sash section S in a window assembly and the magnet 26 housed within the strike 12 (that is fitted into the fixed sash S' in the window assembly) manufacturing tolerances when fabricating a window assembly can result in misalignment between the magnets 26 and 29. This misalignment can come about due to length cutting tolerances, welding allowances and the routing process for both the strike and the fixed rail S' and the latch assembly in the moving rail S of the window assembly. These variations can occur when a window sash is manufactured and can cause up to 6 mm of misalignment between the fixed and moving rails in the window assembly.

Burrs can also be produced during the routing process. As described above the clips 40 of the body 10 of the latch assembly are forced out when the latch furniture 11 is pushed into place thereby ensuring a good fit. The strike 12 according to a preferred aspect of the invention is also designed so as to make allowance for the manufacturing tolerances that can lead to misalignment. According to another aspect of the invention, the strike is also constructed to make allowance for burrs produced by the routing process.

To allow for misalignment the magnet 26 in the strike 12 is captivated in a manner whereby it is free to "float" within the housing 28 to thereby allow for misalignment between magnets 26 and 29.

As previously described the strike 12 is made of three separate components assembled together these comprising the strike body 12*a*, an insertable housing 28 and the magnet 26 (the latter as well as magnet 29 being preferably a cylindrical neodymium-iron-borron magnet. The body 12*a* has a central recess 52 that is used to locate the housing 28. In the bottom of the recess 52 there are two raised portions 53 that are used to hold the magnet 26 up off the bottom of the recess. This is to allow the magnet 26 to slide freely within the housing 28.

The housing 28 when assembled into the body 12*a* encapsulates the magnet 26 so that it can move freely as will hereinafter be apparent. The housing 28 has side clips 54 that when the housing is assembled into the body 12*a* produce a gap between the body and the housing that will lock the complete assembly into the slot T machined into the window section S'.

The housing 28 has a location upstand 55 that fits into the recess 52. This means that the housing 28 is positively located and therefore cannot move longitudinally within the body 12*a*. There are also ledges 56 that form locking steps on either side of the side clips 54 that once assembled into the body lock beneath a notch 57 in the body 12*a*. The notch 57 in the body is also provided in order to allow the side clips 54 to flex inward as the strike assembly is being fitted into the slot formed in the window section S'.

The housing 28 is centrally located thus making the two bolt recesses/openings 16 equal in size. The central location of the housing 28 also is designed for aesthetic reasons.

The cavity 60 in the housing 28 is elongate and therefore enables the cylindrical magnet 26 to be able to slide within the housing between the extremes defined by the curved ends of the cavity 60.

Figure 36:
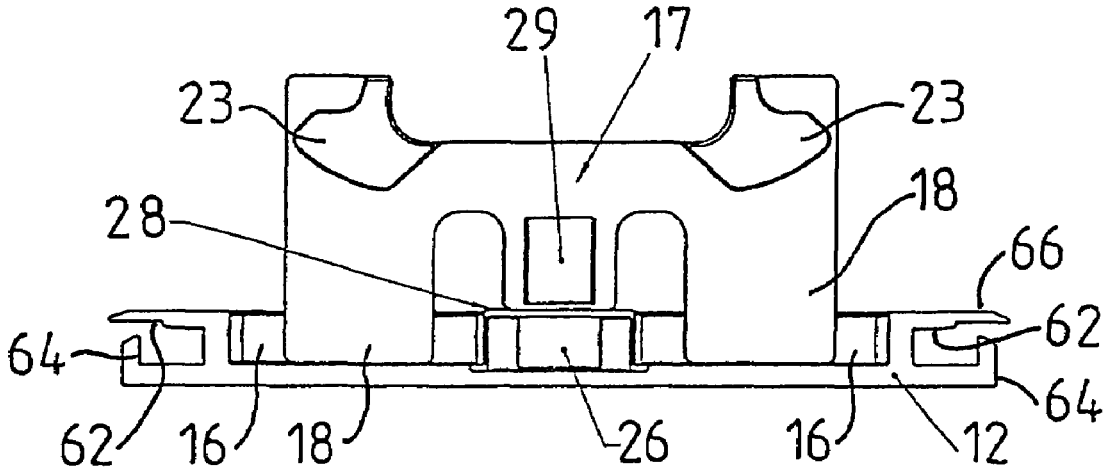
FIG. 36 is a schematic illustration of the bolt assembly of the latch in a latching position with the striker.
Figure 37:
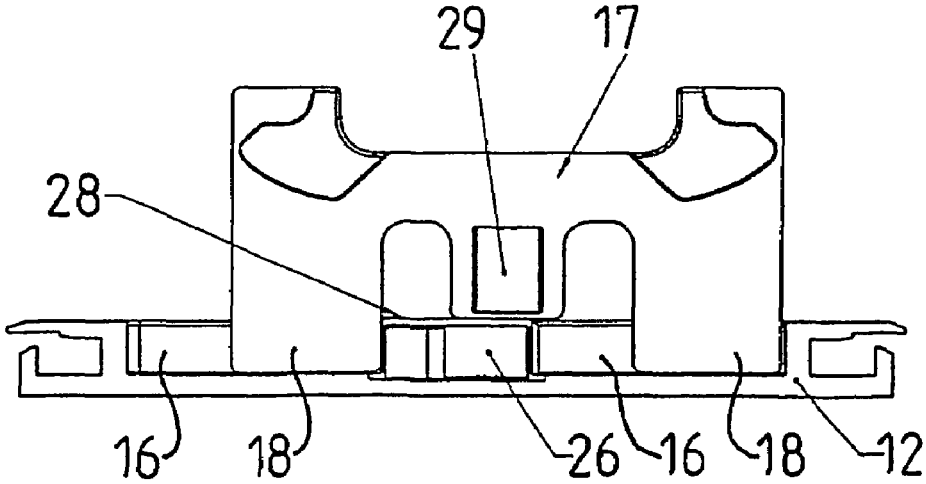
FIG. 37 is a view similar to FIG. 36 but showing a relative offset between the bolt assembly and the striker due to misalignment.

Referring now to FIGS. 36 and 37 the arrangement shown in FIG. 36 shows the magnet 26 in a central location within the housing 28. However, FIG. 37 shows the bolt 6 mm offset from the nominal central position shown in FIG. 36. It will be observed that the magnet has by virtue of its attraction to magnet 29 moved to one extreme end of the housing 28 thereby positioning the two magnets 26 and 29 so that required magnetic attraction between the magnets is achieved.

Therefore, the floating nature of magnet 26 ensures that there is maximum attraction forced between the magnets 26 and 29 and thereby ensures that the latch will always function even when there is up to 6 mm misalignment between the strike 12 and the bolt assembly 17. It therefore ensures that the bolts 18 will still fully enter the recess 16 in strike 12 even if there is a 6 mm maximum displacement in either direction from the nominal central position of the bolts 18 in the strike 12.

Reverting now to the body 12*a* of the strike 12, it will be observed that there is a location upstand 62 at each end thereof. These are used, as will hereinafter become apparent, to locate the strike 12 in the slot T cut into the window section S'. At each end there is also an end clip 64 which is used to securely hold the strike 12 in place. These end clips 64 are shaped so that they will clear any burrs that may be produced by the tool cutting the slot T in the window section S. As indicated above it is the presence of these burrs that historically have caused fitting problems with components of latches fitted into routed openings in a window section.

To further describe the strike and its method of fitment to the rail section S' reference will now be made to installation of the strike into the slot T and with reference to FIGS. 32-35.

Figure 32:
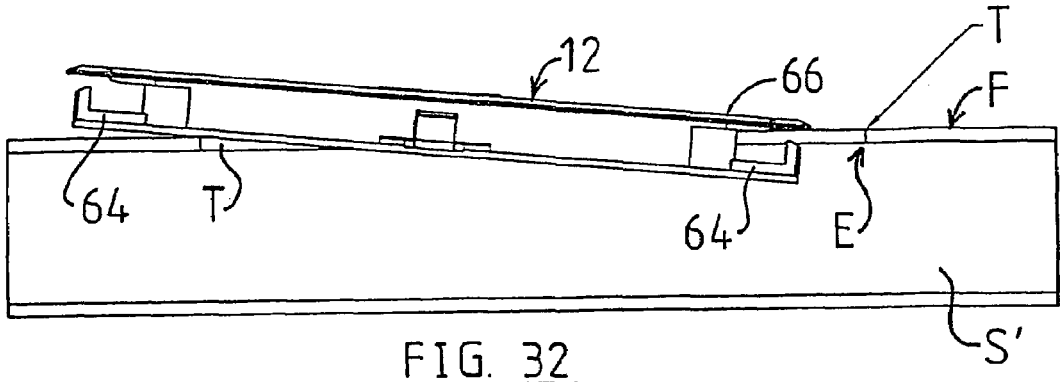
FIGS. 32-35 are illustration of the striker during installation in a window section.
Figure 33:
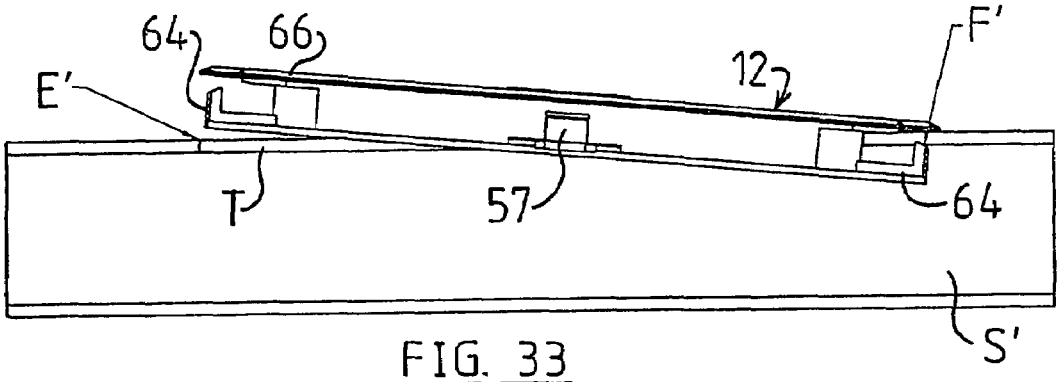

The flange or rim 66 on the top of the body 12*a* will, in use, rest on the top surface F of the section S'. As shown in FIG. 32 one end of the strike is located into the slot T and the strike body 12 is then pushed toward the end E of the slot T such that the end clip 64 goes past the end E of the slot and any burr that may be present. The location upstand 62 has a lead-in on the end to allow the location upstand 62 to slide past the end E of the slot T.

Figure 34:
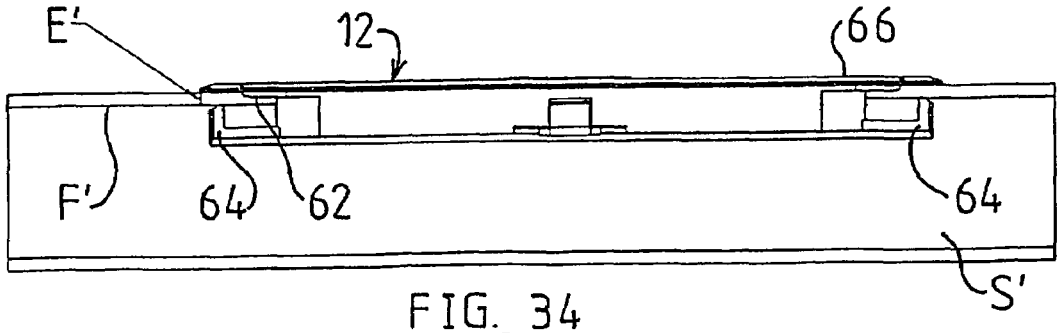
Figure 35:
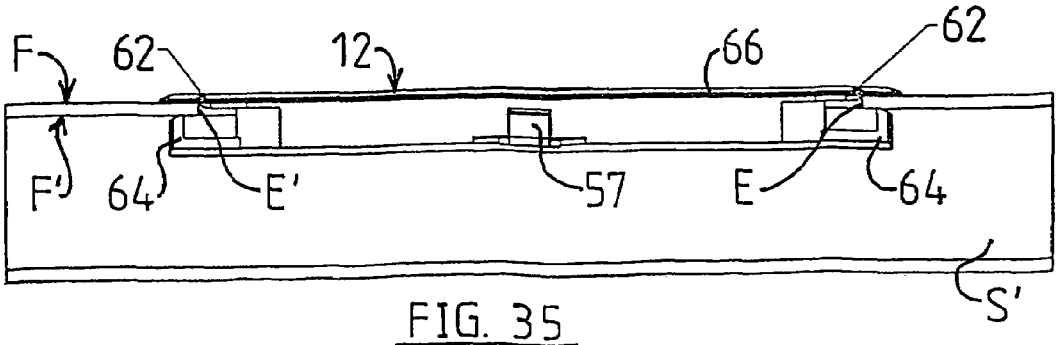

Once this end of the strike body 12*a* has reached the end E of the slot T (FIG. 33) it is then possible to push the other end of the strike body (and consequently the other end clip 64) down into the slot T (see FIG. 34). During this insertion the central clips 54 on the housing 28 are pushed back into the recesses 57 in the strike body 12*a* as the strike 12 is pushed into the slot T.

The strike body 12*a* is then slid toward the end E' such that the location upstand 62 at this end of the strike body contacts the bottom edge F' of the slot T. At this point the other location upstand 62 will have also dropped into the slot. The distance between the outermost edges of the location upstands 62 is slightly smaller than the length of slot T, this being a requirement to ensure that the strike 12 will always fit into the slot T. At this point the strike 12 is located within the slot T (see FIG. 35) and the two end clips 64 are clear of any burrs around the edges of the slot T. The end clips 64, therefore, hold the ends of the strike body 12*a* in the slot T by virtue of their contact with the underside surface F' of the section S'.

The two central clips on the housing 28 are designed so that they are initially clear of the internal section wall and as a consequence when the strike 12 is fully within the slot (FIG. 35) the clips will have sprung out of the recesses in the body 12*a*. The central clips 54 are designed to resist any upward loads placed on the centre of the strike due to the magnetic forces present during operation of the latch mechanism.

Once the strike assembly 12 has been installed into the rail section S' there is no adjustment of the position of the strike assembly required as the strike will automatically adjust for any out of alignment between the latch mechanism and the strike.

The design of both the body 12*a* and the housing 28 are such that there are no visible gaps once the parts have been assembled. This, not only is desirable from an aesthetic point of view but also provides thermal installation properties of the completed window section. The combination of the housing 28 and the body 12*a* are such that when assembled the side clips are produced in a manner which is effective and achieves the end function. This arrangement would otherwise be difficult to produce while still maintaining the no visible gap requirement.

The invention claimed is:

1. A window latch for use with a window sash sliding mounted with a window frame, the latch including:

a body having an operating member mounted thereon for operating the latch;

a strike, at least one bolt moveable between a retracted position and a projecting position relative to the body whereby in the projecting position the bolt is engageable in the strike;

a connecting mechanism coupled to the bolt and operable by the operating member;

a magnetic actuating element including a magnet carried in a magnet carrier that is moveable independently of but coupled to the bolt;

a biasing device to bias the bolt to the retracted position; and a spring resiliently coupling the magnet carrier to the bolt;

wherein when the bolt is in the retracted position but aligned with the strike a magnetic attraction between the strike and the magnetic actuating element occurs to cause movement of the magnetic actuating element relative to the strike, this movement of the magnetic actuating element causing the bolt to move to said projecting position, when the bolt is in the projecting position engaged with the strike, operating the operating member causes the bolt to move to said retracted position thereby causing the spring to apply a retracting force to the magnet carrier and when the bolt is not aligned with the strike the biasing device holds the bolt in said retracted position.

2. A latch as claimed in claim 1 wherein there are a pair of bolts coupled together.

3. A latch as claimed in claim 1 wherein the operating member is a lever handle mounted with an escutcheon member.

4. A latch as claimed in claim 3 wherein the escutcheon member is mounted with the body.

5. A latch as claimed in claim 4 wherein the body includes one or more clip elements which in use clip engage with an opening in a window section in which the body is installed, the escutcheon including engagement means which, upon relative movement between the escutcheon and body engage with and restrict movement of the clip elements.

6. A latch as claimed in claim 5 wherein there is detent which detents the escutcheon on the body to a position where it is located on the body and a position where the engagement means engage with the clip elements.

7. A latch as claimed in claim 6 wherein the clip element is of generally U shape with one leg section thereof fixed to the body and the other leg section having a ramped enlarged section, a distal surface of the enlarged section being of curved configuration.

8. A latch as claimed in claim 7 wherein the clip element further includes a finger that is engageable with the engagement means of the escutcheon.

9. A latch as claimed in claim 1 wherein the biasing device is a spring engaged between the bolt and a fixture, said fixture being fixed in position relative to the body.

10. A latch as claimed in claim 1 wherein the connecting mechanism is a crank pivotally coupled in its length to the body, a first end of the crank being engaged with the operating member and a second end of the crank coupled to the bolt.

11. A latch as claimed in claim 10 wherein said second end is formed with a projection which is engaged in a shaped recess in the bolt.

12. A latch as claimed in claim 11 wherein the first end includes a curved surface which is in contact with a contact surface of the operating member.

13. A latch as claimed in claim 12 wherein the operating member is moveable about a pivot axis, the contact surface being to one side of the pivot axis whereby when the operating member is moved about the pivot axis to an unlatch position the contact surface applies a pressure to the first end of the crank to move the crank whereby the second end causes the bolt to move to the retracted position.

14. A latch as claimed in claim 13 wherein the operating member is coupled to at least one retaining element that retains the operating member in the unlatched position.

15. A latch as claimed in claim 1 wherein the strike includes a cavity into which an end of the bolt, when in the protruding position, engages.

16. A latch as claimed in claim 15 wherein the strike includes a magnetic element which is positioned to be substantially in alignment with the magnetic actuating element when the bolt is aligned with the cavity in the strike.

17. A latch as claimed in claim 16 wherein the magnetic element is moveably retained in the strike whereby the magnetic element can move into the substantially aligned position.

18. A latch as claimed in claim 17 wherein the magnetic element is retained in a housing in the strike.

19. A latch as claimed in claim 18 wherein the housing in part defines the cavity.

20. A latch as claimed in claim 16 wherein the strike includes clip means whereby the strike can be clip fitted into an opening in a section of the window frame.

21. A latch as claimed in claim 16 when fitted into sliding window construction by the body being engaged substantially within a section of a window sash and the strike engaged with a section of the window frame.

22. A latch as claimed in claim 21 wherein the window frame section is a section of a second window sash which is moveable, along with the window sash in which the body is engaged in a window surround frame.

23. A latch as claimed in claim 22 when appendant directly or indirectly to claim 5 wherein the window sash includes a pull rail against which the escutcheon is engaged when the engagement means of the escutcheon are engaged with the clip elements.

24. A latch as claimed in claim 21 wherein the strike is fitted into an opening in the section of the window frame whereby restricted movement of the strike is possible while the strike is retained in the section of the window frame.

25. A latch as claimed in claim 24 wherein the strike includes a flange and a pair of spaced apart clips located adjacent the flange, each clip having a leg which extends in a plane spaced from the plane of the flange and a return position which extends toward the flange but terminates a distance from the flange.

26. A latch as claimed in claim 25 wherein the flange includes a section of increased thickness which is located opposite the leg of the clip.

* * * * *